US007783977B2

(12) United States Patent
Stadheim et al.

(10) Patent No.: US 7,783,977 B2
(45) Date of Patent: Aug. 24, 2010

(54) SYSTEM AND METHOD FOR BALANCING OF VENTILATION SYSTEMS

(75) Inventors: Andrew David Stadheim, Oakdale, MN (US); Nicholas E. Kleinjan, Minneapolis, MN (US)

(73) Assignee: DataNab, LLC, Burnsville, MN (US)

( * ) Notice: Subject to any disclaimer, the term of this patent is extended or adjusted under 35 U.S.C. 154(b) by 759 days.

(21) Appl. No.: 11/540,487

(22) Filed: Sep. 29, 2006

(65) Prior Publication Data

US 2007/0190924 A1 Aug. 16, 2007

Related U.S. Application Data

(60) Provisional application No. 60/721,694, filed on Sep. 29, 2005.

(51) Int. Cl.

| | |
|---|---|
| ***G06F 3/00*** | (2006.01) |
| ***G06F 17/00*** | (2006.01) |
| ***G06F 3/048*** | (2006.01) |
| ***G06F 3/14*** | (2006.01) |

(52) U.S. Cl. ..... 715/700; 715/212; 715/227; 715/810; 715/864

(58) Field of Classification Search ..... 715/4, 715/212, 227

See application file for complete search history.

(56) References Cited

U.S. PATENT DOCUMENTS 7,317,907 B2 * 1/2008 Linkert et al. ..... 455/412.1

OTHER PUBLICATIONS

HVAC TABulator Review and Download, Printed from internet Jul. 30, 2009, http://www.softsea.com/review/HVAC-TABulator.html.*
HVAC Tabulator Software screenshots, created Jul. 30, 2009, Ecologic Systems.*

* cited by examiner

*Primary Examiner*—Tadesse Hailu
*Assistant Examiner*—Nicholas S Ulrich
(74) *Attorney, Agent, or Firm*—Merchant & Gould P.C.

(57) ABSTRACT

A system and method for balancing of ventilation systems. A menu structure is presented by a wireless device, in order facilitate arriving at one or more windows devoted to the particular component to be tested. The aforementioned one or more windows present information concerning the particular component to be tested, and permit entry of measured data. The one or more windows may present information concerning mechanical or electrical details of the component under test, and may present information concerning the specified range within which the measured parameters are intended to fall.

7 Claims, 5 Drawing Sheets

SYSTEM AND METHOD FOR BALANCING OF VENTILATION SYSTEMS

RELATED APPLICATIONS

This application claims the benefit of U.S. Provisional Patent Application Ser. No. 60/721,694, filed on Sep. 29, 2005, and entitled "SYSTEM AND METHOD FOR BALANCING OF VENTILATION SYSTEMS," which is hereby incorporated by reference in its entirety.

TECHNICAL FIELD

The present invention relates generally to a system for entry and manipulation of data relating to balancing of ventilation systems, and more particularly to a wireless, mobile, data entry system in data communication with a network-accessible server for storage and manipulation of the data.

BACKGROUND

As the construction of a building nears completion, the building undergoes various forms of inspection to ensure that its assorted systems work properly. For example, the building may be inspected to ensure that its electrical and plumbing systems function as intended. One particularly labor-intensive inspection process that must be undertaken is inspection of the ventilation system serving the building.

For a given building, the ventilation system may include many components. For example, a ventilation system typically includes one or more air outlets (also referred to herein as "diffusers" or "vents") within each room of the building. In the context of a large office building, for example, the ventilation system also may include one or more roof top units, air-handling units, energy recovery units, exhaust fan units, variable air volume boxes, pumps, and balance valves, each of which are interconnected by a duct system (or plumbing system) extending throughout the building. During inspection of the ventilation system, each of the aforementioned components must be tested to determine that they are functioning as specified. For example, each air outlet in the entire building must be inspected to determine whether it is delivering the proper volume of air per unit interval of time. This process may occupy the services of several inspectors, and may take many days or weeks to complete.

Traditionally, as each component of the ventilation system is tested, the functional parameters of the component are recorded (e.g., are written down in a notebook). For example, an inspector records, for each air outlet within a given building, the volume of air per unit interval of time passing through the outlet. As a given component is tested, the inspector usually determines whether its measured functional parameters fall within the range specified by the designer. If the parameter falls outside of the specified range (e.g., a given air outlet is delivering too much air), the inspector attempts to bring the parameter within the specified range, if possible (e.g., manipulates a damper to alter the amount of air passing through an associated outlet). However, in some instances, a given component exhibits a deficiency that cannot be corrected by the inspector. In response to such a deficiency, the inspector records the deficiency (e.g., writes the deficiency down in his notebook) and proceeds to test the next component.

After each of the components of the ventilation system has been tested, a master list of the measured functional parameters for each component is compiled. Additionally, a master list of deficiencies observed within the ventilation system is also compiled. Upon compilation of the deficiency list, the appropriate contractor is contacted and informed of the deficiency, so that the contractor can remedy the defect. After a contractor has serviced a particular component, the inspector again tests the component to determine whether the component is indeed functioning as specified.

The aforementioned inspection scheme exhibits certain shortcomings. For example, because contractors are not contacted until a master deficiency list is generated, and because a master deficiency list is not compiled until all of the various components have been tested, contractors are not immediately made aware of defects. In some instances, the appropriate contractors may have left the building site by the time they are made aware of deficiencies, meaning that they have to travel back to the site in order to service any defective components. Further, the aforementioned system allows for undetected duplication of effort. For example, two inspectors may unintentionally measure the functional parameters of the same set of components. Such duplication is not observed until the master list of functional parameters is compiled, and it is revealed that two inspectors tested the same components. Still further, the aforementioned scheme does not permit for billing until the entire project has been completed.

As the foregoing makes clear, there exists a need for a system that enables efficient and effective inspection of ventilation systems. Such a system is preferably relatively easy to use and inexpensive to deploy.

SUMMARY

According to some embodiments, a computerized method of providing a user interface for entry of ventilation data includes providing a menu of a plurality of ventilation projects. A selection of one of the ventilation projects may be received. A menu of ventilation component types may be provided, based upon the selected ventilation project. A selection of one of the ventilation component types may be received. A menu of individual ventilation components of the selected ventilation component type, known to be present within the selected ventilation project may be provided. A user interface for entry of ventilation data may be provided.

DETAILED DESCRIPTION

Figure 1:
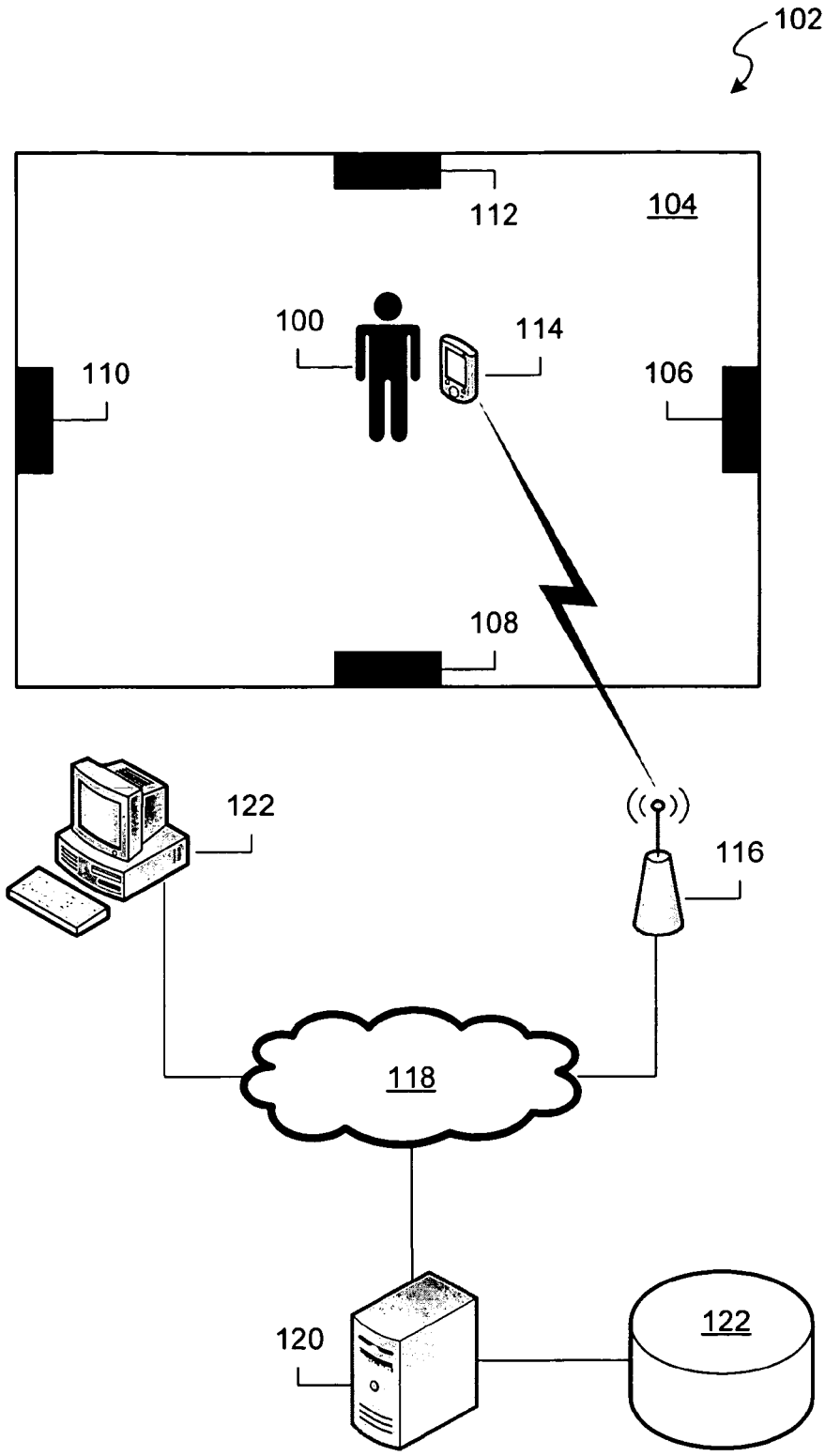
FIG. 1 depicts an inspector interfacing with an embodiment of the system for presenting and entering of ventilation data.

Various embodiments of the present invention will be described in detail with reference to the drawings, wherein like reference numerals represent like parts and assemblies throughout the several views. Reference to various embodiments does not limit the scope of the invention, which is limited only by the scope of the claims attached hereto. Additionally, any examples set forth in this specification are not intended to be limiting and merely set forth some of the many possible embodiments for the claimed invention.

FIG. 1 depicts an inspector 100 within a building site 102. The site 102 includes one room 104, which is outfitted with four ventilation components 106-112. It is understood that the site 102 depicted in FIG. 1 is drastically simplified for the sake of illustration. Further, it is understood that an actual site would contain many rooms, and would include a variety of ventilation equipment, the total number of which would be in excess of four.

As described in the Background section herein, it is the function of the inspector 100 to ensure that each component 106-112 of the ventilation system serving the site 102 is operating as intended. To aid in testing the various components 106-112 of the system 112, the inspector 100 may use various measurement equipment (not depicted in FIG. 1). For example, the inspector 100 may possess an air flow meter that determines the volume of air emanating from a particular air outlet per unit interval of time. Upon measurement of a given functional parameter, the measured data is entered into a graphical user interface presented by the wireless device 114 (the graphical user interface is discussed in more detail, below). Accordingly, the inspection process generally proceeds thusly. The inspector 100 begins by approaching a first component within the ventilation system. The inspector 100 navigates through a menu structure presented by the wireless device, in order to arrive at one or more windows devoted to the particular component to be tested. The aforementioned one or more windows present information concerning the particular component to be tested, and permit entry of measured data. For example, the one or more windows may present information concerning mechanical or electrical details of the component under test, and may present information concerning the specified range within which the measured parameters are intended to fall. After navigating the menu structure to arrive at the one or more windows devoted to the component to be tested, the inspector 100 proceeds by testing the particular ventilation component, and measuring its functional parameters. The measured functional parameters are entered into the aforementioned data entry window presented by the wireless device 100. If the functional parameters fall outside of the specified range, the inspector 100 attempts to remedy the situation. If this effort proves unfruitful, the inspector 100 determines the source of the problem, and records the deficiency in the wireless device 114. Thereafter, the inspector 100 proceeds to the next component of the ventilation system, and the process is repeated, on a component-by-component basis until every component has been tested.

According to some embodiments, the wireless device 114 establishes a communication link with a wireless access point 116, which ultimately permits communication, via a network 118, with a remote server 120 (it is understood that the server 120 may actually be embodied as more than one server, and that the functionality it is described as providing may actually be provided by the cooperative efforts of more than one server). The remote server 120 maintains a database 122, which contains data concerning the ventilation components of the site 102, and of other sites as well. Thus, all of the measured functional parameters entered into the wireless device 114 are communicated to the server 120, and are stored in the database 122. Of course, the opposite function occurs, as well—functional parameters (such as those entered by other inspectors working at the same site) are retrieved from the database 122, and are communicated to the wireless device 114. The process of ensuring that both the wireless device 114 and the database 122 maintained by the remote server 120 contain the most current data is known as "synchronization," and is understood in the art.

According to other embodiments, the wireless device 114 may couple to a computer 124, such as via a serial port (e.g., a USB port). The computer 124, is, in turn, coupled to the network 118. Thus, upon coupling to the computer 124, the wireless device 114 carries out the synchronization functions described above, as well as other functions described herein.

Figure 2:
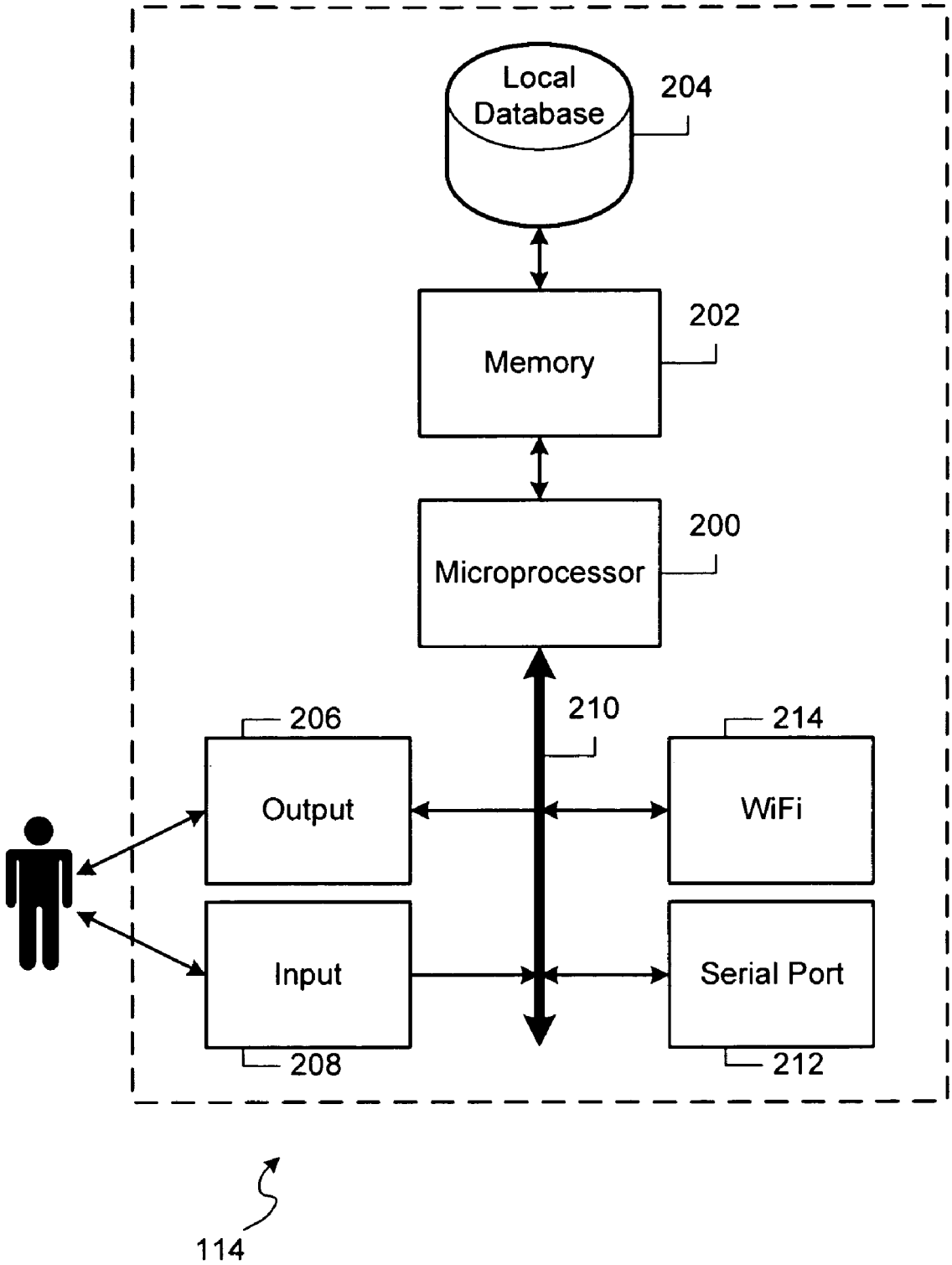
FIG. 2 depicts an exemplary embodiment of the wireless device of FIG. 1.

An exemplary embodiment of the wireless device 114 is generally depicted in FIG. 2. As can be seen therein, the device 114 includes a processor 200 that is coupled to a memory unit 202. The memory unit 202 may consist of several stages of memory varying in size and speed. In any event, the memory unit 202 stores data and instructions for execution by the processor 200. The memory unit 202 maintains a local database 204 that contains information concerning one or more sites. After synchronization with the database 122 maintained by the remote server 120 (FIG. 1), the local database 204 contains an exact copy of the data stored within the remote database.

The wireless device also includes an input device 208 and an output device 206 by which the inspector interacts with the device. For example, the input device 208 may be embodied as a touch screen, a mouse, a pointing device, a keyboard, etc. The output device 206 may be embodied as a display, a touch screen, a speaker, etc. The input and output devices 206 and 208 are in data communication with the processor 200 via a bus 210. The bus 210 also couples a serial port 212 to the processor. The serial port 212 may be used, for example, for communication with a computer, such as the computer 124 depicted in FIG. 1. The bus 210 also provides communication between the processor 200 and a wireless interface 214. The wireless interface 214 establishes the aforementioned communication link, such as a communication link according to the IEEE 802.11 standards. Of course, it is understood that the wireless device may contain more than one bus for communicating information between the processor 200 and the various peripherals 206-214, although a single bus 210 is depicted in FIG. 2.

The wireless device 114 may be embodied, for example, as a personal digital assistant (PDA), a cellular telephone, a palm-top computer, etc.

Figure 3:
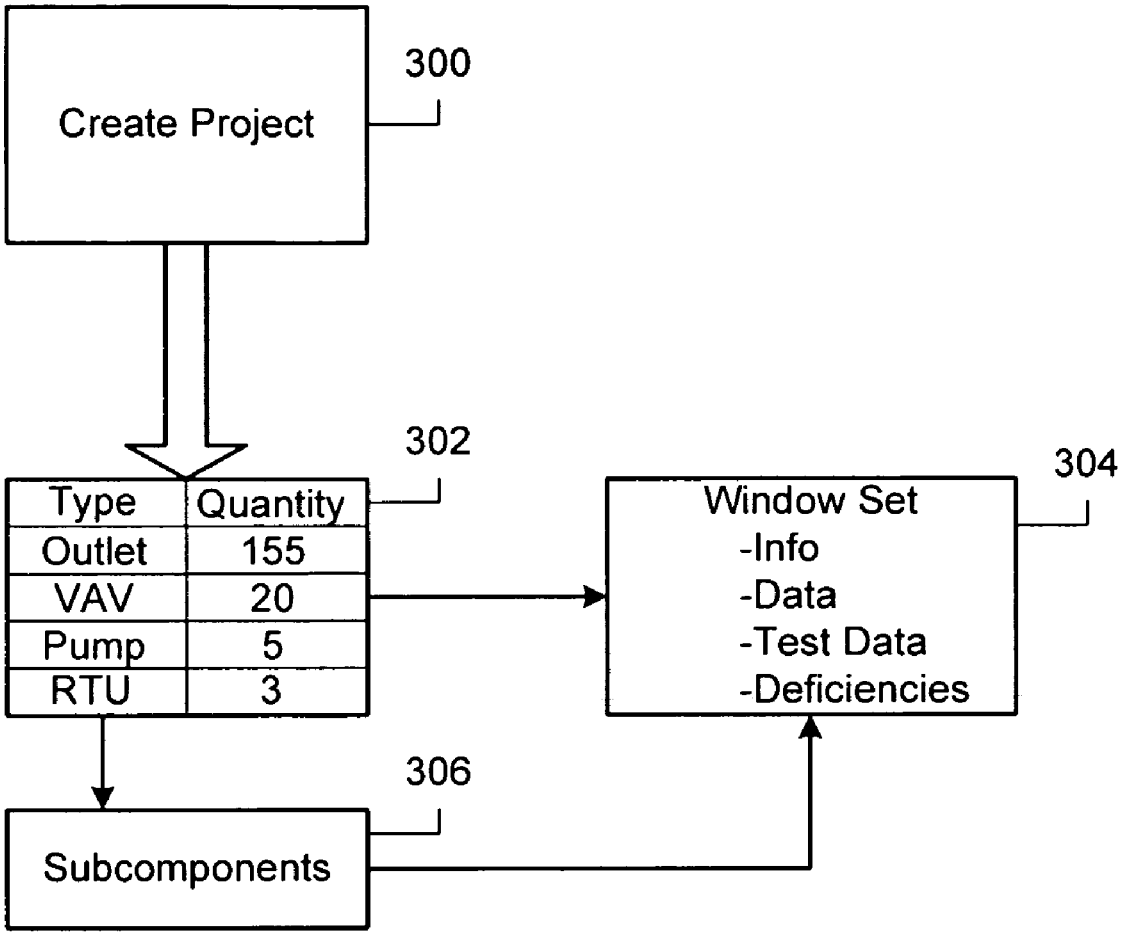
FIG. 3 depicts an exemplary embodiment of the software executing upon the wireless device, remote server, or computer depicted in FIG. 1.

FIG. 3 depicts an exemplary embodiment of the software stored in the memory 202 (FIG. 2) and executed by the processor 200 (FIG. 2) of the wireless device 114. The software depicted in FIG. 3, or any functional subset thereof, may also execute upon the remote server 120 (FIG. 1), upon computer 124 (FIG. 1), or any other computer. As can be seen from FIG. 2, the software includes a project creation module 300. The project creation module 300 provides an interface that permits a user to define the set of ventilation equipment to be tested at a given site. Thus, for example, the project creation module 300 presents the user with a list of types of ventilation components typically used to service buildings. According to one embodiment, the list includes the following types of components: roof top units, air-handling units, energy recovery units, air outlets, exhaust fan units, variable air volume boxes, pumps, and balance valves. For each ventilation component presented by the module 300, the user may specify the quantity of such components to be tested at the site. Thus, for example, if a site is known to possess one-hundred and fifty-five air outlets, the user may specify that quantity for the "air outlet" type of component. Data module 302 represents the outcome of having defined a project by specifying the quantity of each of the various types of components to be found at a given site.

In response to specifying a quantity of a particular type of component to be found at a site, a like number of windows 304 are created for presenting and receiving data for the particular type of component. Thus, there exists a one-to-one correspondence between windows 304 and ventilation components (there is one window for each ventilation component). For example, if the user specifies that a site possesses one-hundred and fifty-five air outlets, then one-hundred and fifty-five windows—one for each air outlet—are created. Optionally, instead of producing one window for each component, a set of tabbed windows 304 may be created for each component. Thus, carrying on with the previous example, one-hundred and fifty-five sets of tabbed windows are created—one set for each air outlet. FIGS. 4A-4D depict an exemplary embodiment of a set of tabbed windows presenting information and permitting data entry of information relating to an air-handling unit.

Figure 4A:
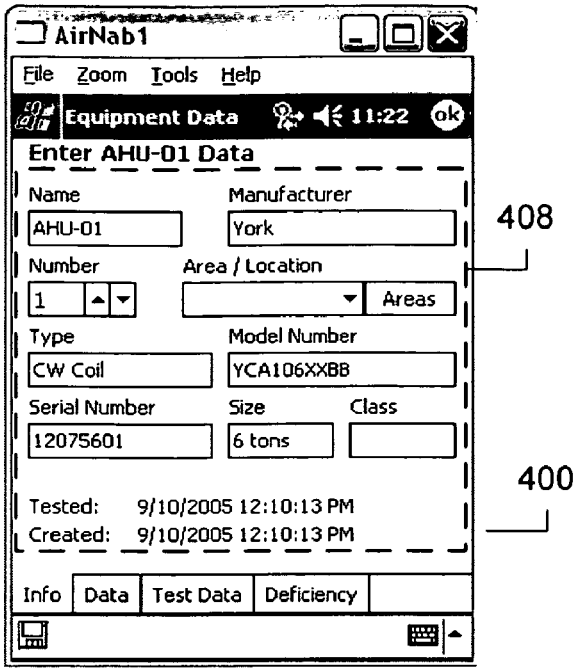
FIGS. 4A-4D depict exemplary embodiments of windows for presentation and reception of data concerning an air-handling unit.

As can be seen from FIG. 4A, the set of tabbed windows 304 includes four associated windows: (1) an information window 400 (displayed in FIG. 4A); (2) a data window 402 (displayed in FIG. 4B); (3) a test data window 404 (displayed in FIG. 4C); and (4) a deficiency window 406 (displayed in FIG. 4D). The information window 400 includes an area 408 for presentation of information identifying the particular ventilation component. For example, the area 408 may includes fields for entering/presenting information concerning a name assigned to the ventilation component by the inspector or assigned automatically by the wireless device, the manufacturer of the component, a sequence number assigned to the component (e.g., assuming there exist a quantity of N air outlets, a sequence number, M, identifies a particular set of tabbed windows as referring to the $M^{th}$ of N air outlets), an area or location within the building in which the component is located, a model number of the component, a type description of the component, a serial number of the component, a size description of the component, a class description of the component, and so on. The information presented by the information window may be retrieved from either the local database maintained by the wireless device or by the remote database, meaning that it may be entered via the wireless device, at the remote server, or at any computer in data communication with the remote server or wireless device, such as by computer 124 (FIG. 1).

Figure 4B:
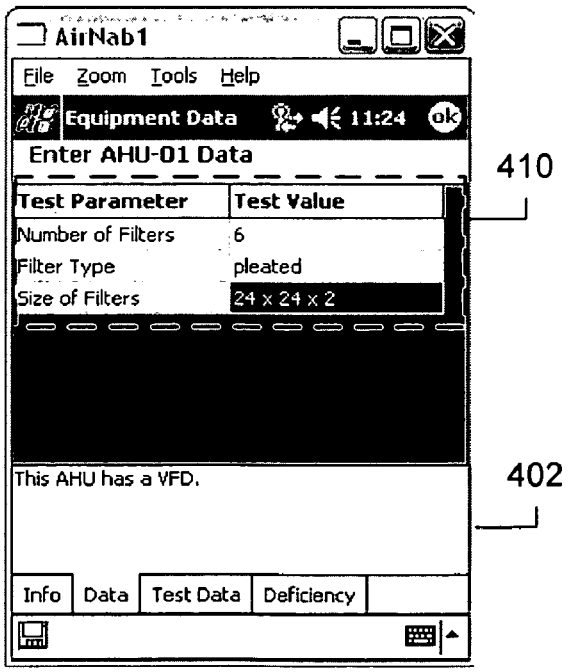

FIG. 4B depicts an exemplary embodiment of the data window 402. The data window includes an area 410 presenting information concerning various parameters a given component may exhibit. Typically, the data within area 410 is entered by the inspector as the inspector observes the component. Thus, in the context of an air handling unit, such a component may possess various quantities of filters, types of filters, and sizes of filters. As can be seen from FIG. 4B, the data window 402 presents fields for entry of such parameters. The information presented by the data window may be retrieved from either the local database maintained by the wireless device or by the remote database, meaning that it may be entered via the wireless device, at the remote server, or at any computer in data communication with the remote server or wireless device, such as by computer 124 (FIG. 1).

Figure 4C:
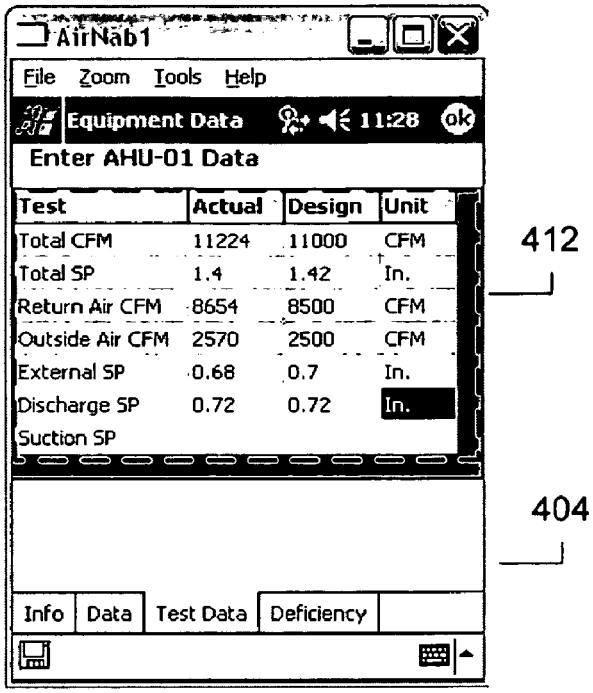

FIG. 4C depicts an exemplary embodiment of a test data window 404. The test data window 404 includes a table-like area 412 for entry of measured functional parameters, and for presentation of the specified values for such parameters. In the particular embodiment depicted in FIG. 4C, the table is organized so that each row therein corresponds to a particular functional parameter to be measured. The first column of a given row identifies the particular functional parameter corresponding to the row. The second column of a given row is a field that permits entry of the measured value. The third column presents the intended or specified value of the functional parameter, and the fourth column presents the units in which measured and specified values are presented. The information presented by the test data window may be retrieved from either the local database maintained by the wireless device or by the remote database, meaning that it may be entered via the wireless device, at the remote server, or at any computer in data communication with the remote server or wireless device, such as by computer 124 (FIG. 1).

Figure 4D:
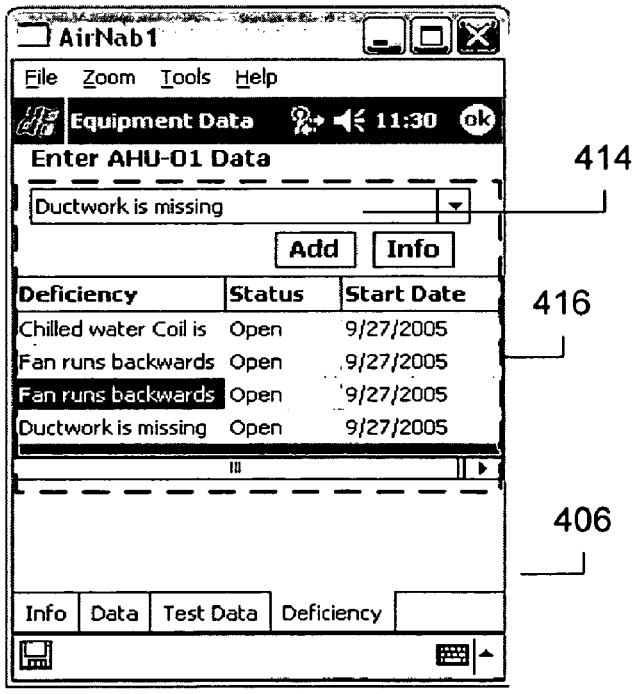

FIG. 4D depicts an exemplary embodiment of a deficiency window 406. The deficiency window 406 includes an area 416 in which the various deficiencies (if any) observed with the corresponding component may be entered. The deficiency window also includes a menu 414 that contains the various possible deficiencies that typically are presented by a given component. Thus, upon observing a deficiency with a given component, the inspector may access the menu 414 and is likely to observe a text string describing the deficiency therein. Selection of the text string adds the deficiency to the deficiency list presented within the aforementioned area 416. The information presented by the deficiency window 406 may be retrieved from either the local database maintained by the wireless device or by the remote database, meaning that it may be entered via the wireless device, at the remote server, or at any computer in data communication with the remote server or wireless device, such as by computer 124 (FIG. 1).

Returning to discussion of FIG. 3, the embodiment depicted therein permits for definition of composite components. For example, "roof top units" and "air handling" units are terms used to describe an agglomeration of components typically sealed within a housing and sold as a unit. Therefore, the term "roof top unit," for example, does not convey knowledge regarding what sort of equipment is actually contained within such a unit. To accommodate for this, the project creation module 300 provides a menu structure that permits a user to define the quantities and sorts of components (represented by subcomponents module 306 in FIG. 3) making up a given composite component (e.g., roof top unit). After such definition has been performed, a window or window set of the variety described above is created for each subcomponent of the composite component.

According to some embodiments, the aforementioned organization of information and windows finds symmetric expression in the menu structure navigated by the inspector during the inspection process. To assist an inspector in arriving at a window set corresponding to a given component, the software initially provides an interface permitting the inspector to select from amongst defined projects. Thus, an inspector assigned to inspect "ABC" building initially selects "ABC" project from a menu of defined projects. After such selection, the software provides an interface permitting selection of component type (i.e., roof top unit, air outlet, air handling unit, etc.). As the inspector approaches a given component to test it, the inspector selects the type from the menu structure. In the wake of selection of component type, the software provides an interface identifying each instance of the selected component type within the project (e.g., if the selected component type is "air outlet," and if the project was described via project definition module 300 as containing one hundred air outlets, then the software provides an interface presenting each of the air outlets for selection). Finally, upon such selection, the appropriate window or window set is opened for presentation and reception of data. In the event that the selected component type is a composite component, however, the software provides an interface identifying the subcomponents within the composite component. The inspector may select the subcomponent he intends to test, and in response to such selection, the appropriate window or window set is opened for presentation and reception of data.

According to an alternate embodiment of the menu structure, the software provides an interface permitting selection of location within the site. According to one embodiment, the software provides a graphical presentation of the floor plan of the site, and the user may select the room or location in which he intends to test ventilation components. In response to such a selection, the software provides a list of all of the ventilation components within the selected room or location. The inspector may then select the particular component from the aforementioned list, and in response to such selection, the appropriate window or window set is opened for presentation and reception of data.

According to one embodiment, the software executing on the wireless device, remote server, or computer 124 maintains a database that associates each of the components of a ventilation system with its measured data and other information, as described above. The databases maintained by the wireless device, remote server, or computer 124 may associate either a cost of inspecting a given component (or subcomponent of a compound component) or an amount of time expected to be consumed in testing a given component/subcomponent. By virtue of the aforementioned association(s), the computer 124 (or any other system running the software) can provide incremental billing statements, i.e., bills that charge clients for the proportion of a given project that has been completed. According to the embodiment where a cost of inspecting a given component is associated with the component, the system accesses the database to determine the identity of components that have been tested. Thereafter, the system determines an incremental charge by summing each of the costs associated with the components that have been tested. Alternatively, where an expected time for inspection is associated with each component, the system first accesses the database to determine the identity of components that have been tested. Thereafter, the system sums each of the expected inspection times associated with the components that have been tested, and determines therefrom the fraction of the job that has been completed. The resulting fraction is multiplied by the bid price, and the incremental charge is thereby determined.

According to one embodiment, the wireless device, the remote server, or the computer 124 (or any other computer running the software described herein and having access to one of the remote or local databases) generates a deficiency list from time to time. The deficiency list is generated by accessing the remote or local databases, preferably after synchronization. The database is accessed to identify all of the deficiencies observed for a given project. The set of deficiencies is presented in a report that may be printed or displayed via a user interface, for example. According to one embodiment, the set of deficiencies is organized according to contractor. Thus, for example, an electrical contractor views a set of deficiencies that need electrical remedying. According to another embodiment, the set of deficiencies is organized according to location within the site. For example, the set of deficiencies is organized according to rooms in which the defective components are located. This allows a inspector to walk into a room on a floor and pull-up all deficiencies for that specific room—therefore they are able to check and verify if the painter, plumber, electrician etc has performed the work to fix the previously reported deficiencies with that "location" or piece of equipment i.e. "AHU-1". Additionally, as deficiencies are reported AND resolved, the action of creation or completion is time date stamped and can be allowed to auto notify all parties or the user can setup to manually trigger the notification process. The notification process when automated spans across multiple notification mediums—not just expressly email. It can be notified to another user using the airnab tool as well as automatically sent via fax, sms messaging etc.

According to one embodiment, the database maintained by the remote server or by the computer 124 or by the wireless device, associates contact information for each contractor associated with a given deficiency. The system accesses the contact information to transmit a notification of the deficiency string and/or other information to the appropriate contractor, thereby automatically notifying the correct contractor of a deficiency.

The various embodiments described above are provided by way of illustration only and should not be construed to limit the invention. Those skilled in the art will readily recognize various modifications and changes that may be made to the present invention without following the example embodiments and applications illustrated and described herein, and without departing from the true spirit and scope of the present invention, which is set forth in the following claims.

Furthermore, in the foregoing detailed description, various features are occasionally grouped together in a single embodiment for the purpose of streamlining the disclosure. This method of disclosure is not to be interpreted as reflecting an intention that the claimed embodiments of the subject matter require more features than are expressly recited in each claim. Rather, as the following claims reflect, inventive subject matter lies in less than all features of a single disclosed embodiment. Thus, the following claims are hereby incorporated into the detailed description, with each claim standing on its own as a separate preferred embodiment.

The claimed invention is:

1. A computerized method of providing a user interface for entry of ventilation data, the method comprising:

providing a menu of a plurality of ventilation projects;

receiving a selection of one of the ventilation projects;

providing a menu of ventilation component types, based upon the selected ventilation project;

receiving a selection of one of the ventilation component types;

providing a menu of individual ventilation components of the selected ventilation component type, known to be present within the selected ventilation project; and providing a user interface for entry of ventilation data;

wherein the user interface for entry of ventilation data includes, for each ventilation component associated with a ventilation project, a set of windows;

wherein the set of windows includes a window for entry of information concerning the operational parameters of a particular ventilation component; and wherein the window for entry of information concerning the operational parameters of the ventilation component includes one or more fields for entry of a quantity of a particular part found within said particular ventilation component and description of said particular part.

2. The computerized method of claim 1, wherein the set of windows includes a window for entry of information identifying a particular ventilation component.

3. The computerized method of claim 2, wherein the window for entry of identification information includes a field for entry of a serial number of said particular ventilation component.

4. The computerized method of claim 1, wherein the set of windows includes a window for entry of information test information concerning a particular ventilation component.

5. The computerized method of claim 1, further comprising:

storing said ventilation data in a database maintained on a wireless device.

6. The computerized method of claim 5, further comprising:

synchronizing information in said database maintained on said wireless device with information stored in a database maintained on a server located remotely from said wireless device.

7. A computerized method of providing a user interface for entry of ventilation data, the method comprising:

providing a menu of a plurality of ventilation projects;

receiving a selection of one of the ventilation projects;

providing a menu of ventilation component types, based upon the selected ventilation project;

receiving a selection of one of the ventilation component types;

providing a menu of individual ventilation components of the selected ventilation component type, known to be present within the selected ventilation project; and providing a user interface for entry of ventilation data;

wherein the user interface for entry of ventilation data includes, for each ventilation component associated with a ventilation project, a set of windows; and wherein the set of windows includes a window for entry of information concerning defects exhibited by a particular ventilation component.

* * * * *